United States Patent [19]

Rottenkolber

[11] 4,102,602

[45] Jul. 25, 1978

[54] ROTOR FOR AN AXIAL TURBINE

[75] Inventor: Paul Rottenkolber, Wolfsburg, Fed. Rep. of Germany

[73] Assignee: Volkswagenwerk Aktiengesellschaft, Fed. Rep. of Germany

[21] Appl. No.: 811,171

[22] Filed: Jun. 29, 1977

[30] Foreign Application Priority Data

Aug. 31, 1976 [DE] Fed. Rep. of Germany ..... 2639200

[51] Int. Cl.[2] ..... F01D 5/32

[52] U.S. Cl. ..... 416/221; 416/241 B

[58] Field of Search ..... 416/219–221, 416/241 B, 193 A

[56] References Cited

U.S. PATENT DOCUMENTS

| | | | |
|---|---|---|---|
| 2,317,338 | 4/1943 | Rydmark | 416/221 |
| 2,667,327 | 1/1954 | Hardigg | 416/221 |
| 2,783,967 | 3/1957 | Scharf et al. | 416/241 B |
| 2,821,357 | 1/1958 | Schörner | 416/241 B X |
| 3,784,320 | 1/1974 | Rossmann et al. | 416/241 B X |
| 3,832,092 | 8/1974 | Manharth | 416/220 |

FOREIGN PATENT DOCUMENTS

| | | | |
|---|---|---|---|
| 1,281,033 | 11/1961 | France | 416/220 |
| 691,380 | 5/1953 | United Kingdom | 416/221 |
| 753,229 | 7/1956 | United Kingdom | 416/241 B |

*Primary Examiner*—Everette A. Powell, Jr.
*Attorney, Agent, or Firm*—Brumbaugh, Graves, Donohue & Raymond

[57] ABSTRACT

A turbine rotor is constructed by attaching ceramic turbine blades to a metallic disk. Each of the ceramic blades has an enlarged base which is mounted within an undercut axial groove on the disk. Cushion pads are provided between the turbine blade base and the undercut portion of the groove. The cushion pads are designed with a different radius of curvature than the disk base and a yield pressure which is less than the allowable surface pressure of the ceramic. The rotor construction results in a design which significantly reduces the possibility of turbine blade damage from stresses during use.

8 Claims, 2 Drawing Figures

ROTOR FOR AN AXIAL TURBINE

BACKGROUND OF THE INVENTION

This invention relates to rotors for axial flow turbines, such as gas turbines. In particular, this invention relates to such rotors wherein ceramic rotor blades are mounted to a metallic rotor disk.

Gas turbine efficiency is directly related to the temperature of the turbine working gas. Ceramic turbine blades, which can withstand exposure to very high temperature gases, are advantageously used to provide improved turbine efficiency. The ceramic turbine blades can be mounted to a metallic disk by providing an enlarged base portion on each blade which engages an undercut groove on the metallic disk. The direct mounting of the ceramic to the metal disk can cause excess pressure and stresses on the supporting surface of the ceramic. In prior art designs, such as shown in published German Patent Application No. 2,108,176, intermediate layers of cushioning material are placed between the ceramic base portion and the undercut supporting surface of the disk to prevent stress and breakage of the ceramic base portion. In this prior art design, a highly elastic metal felt, capable of relatively large deformation is used. This cushion pad permits substantial movement of the turbine blade under centrifugal forces, from its position when the rotor is stationary, to a different position relative to the disk when the rotor is at full speed. In this prior design, the entire supporting surfaces of the base portion are always in contact with the cushioning pad. In the event of dimensional changes in the blade base or rotor because of manufacturing tolerances, the blade base may be subjected to additional stresses or bending moments on account of this mounting technique. In some instances, the stresses generated may exceed the centrifugal forces on the base and cause fracture of the ceramic.

It is therefore an object of the present invention to provide an axial flow turbine rotor with an improved arrangement for the mounting of ceramic rotor blades to a metallic rotor disk.

It is a further object of the invention to provide such an arrangement wherein bending moments on the base of the ceramic rotor blade do not result in excess stress in the ceramic.

SUMMARY OF THE INVENTION

In accordance with the invention, there is provided a rotor for an axial flow turbine having a metallic disk with a plurality of spaced apart undercut grooves around its periphery. Ceramic rotor blades having an enlarged base portion with first supporting surfaces are mounted in each of the undercut grooves. The supporting surfaces on the rotor blades engage second supporting surfaces on the disk, consisting of the undercut portion of the grooves. Cushion pads are interposed between the first and second supporting surfaces. Each cushion pad is fabricated from resilient material with a selected yield pressure, less than the allowable surface pressure of the ceramic. The cushion pads have a first cushion surface engaging the first supporting surface, but having a different radius of curvature than the first supporting surface. The first cushion surfaces contacts the first supporting surfaces over a relatively small area when the rotor is at rest and with increasing contact area when the rotor is rotating and the surfaces are urged together under centrifugal forces acting on the blades.

The first supporting surfaces on the rotor base are preferably concave and have a larger radius than the first cushion surface on the cushion pads. The grooves in the metallic disk are arranged in axial direction or with some angular deflection having a radially inner portion of circular cross-section. Each cushion pad may be an elongated pad having an oval cross-section and two oppositely facing cushion surfaces, each with a radius of curvature which is less than the radius of curvature of the corresponding supporting surfaces. The cushion pad is advantageously coated with an antifriction material. The blades may be held in position on the disk by locking plates acting on the radially inner end of the blade base portion and bearings on the radially inner end of the groove. The locking plates may be supported in longitudinal recesses provided in the disk grooves and have tongues bent radially inward and outward for engaging the blade base and the metallic rotor disk to provide axial support for the rotor blade.

For a better understanding of the present invention, together with other and further objects, reference is made to the following description, taken in conjunction with the accompanying drawings, and its scope will be pointed out in the appended claims.

DESCRIPTION OF THE INVENTION

Figure 1:
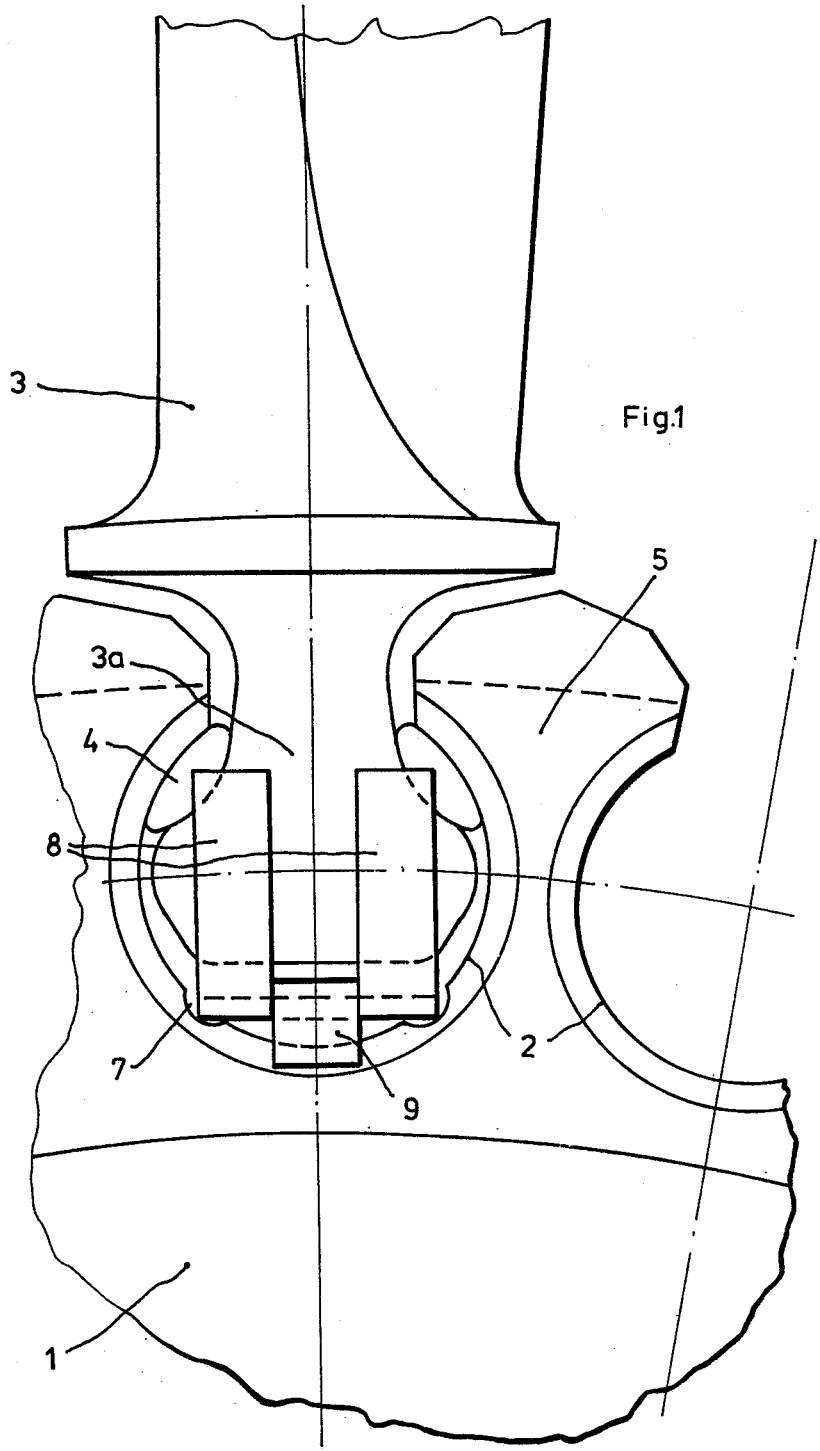
FIG. 1 is a partial axial view of a turbine rotor in accordance with the present invention.
Figure 2:
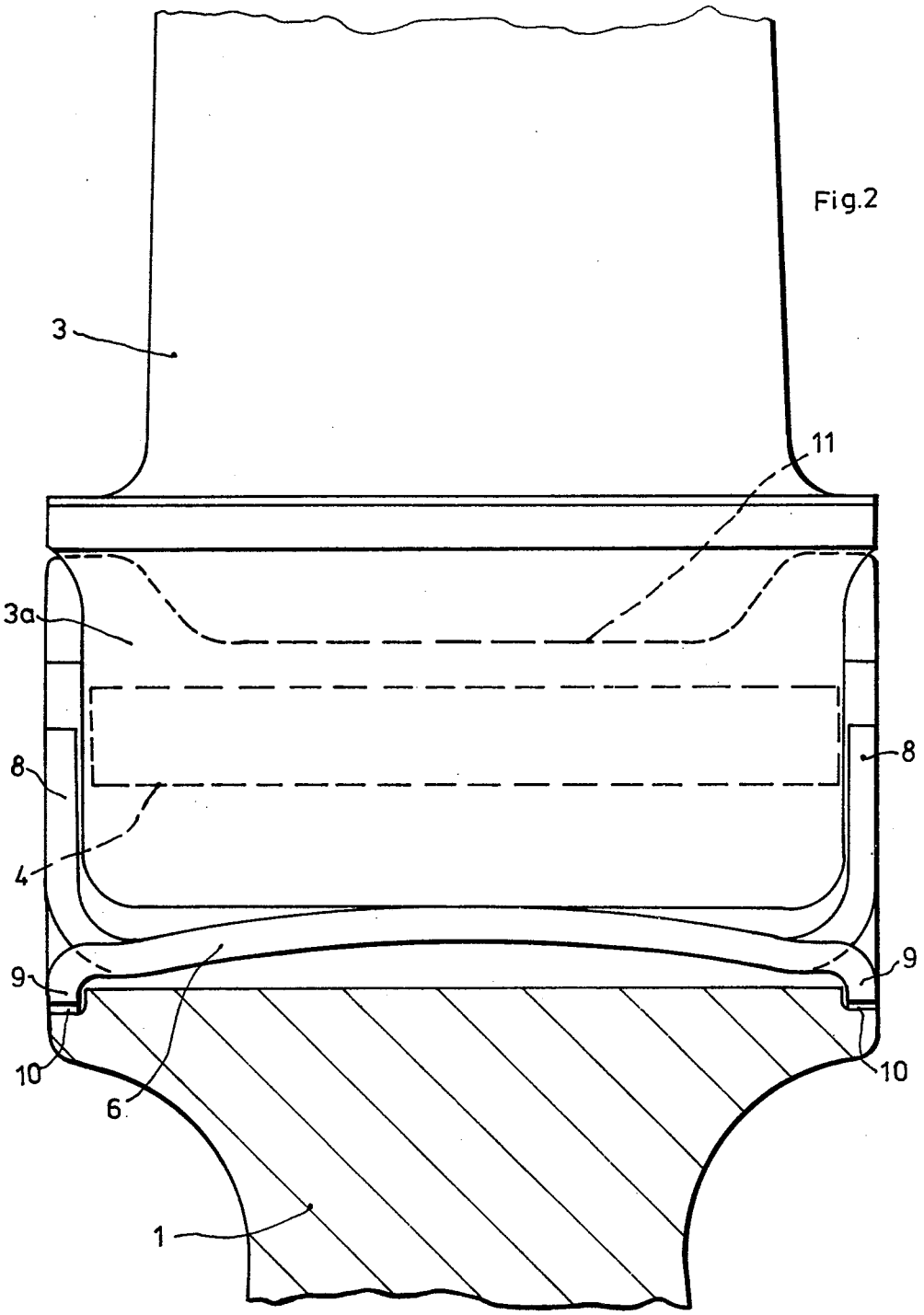
FIG. 2 is a partial cross-sectional view of the turbine rotor of FIG. 1.

FIGS. 1 and 2 illustrate portions of a turbine rotor, particularly the construction of the rotor blade and metallic rotor disk in the vicinity of turbine blade mounting. A metallic rotor disk 1 is provided with axial undercut grooves 2 spaced around its periphery. Ceramic rotor blades 3 are mounted in grooves 2 by the use of a locking plate 6 and cushion pads 4. The axial grooves 2 have a radially inner portion which is of circular cross-section and an outer slot portion, between which are projecting sections 5. The ceramic rotor blades 3 are each provided with an enlarged base portion 3*a* which fits within the circular portion of groove 2. Blade base 3*a* has concave supporting surfaces which engage cushion pads 4. As illustrated in the cross-sectional view of FIG. 2, base portion 3*a* is pushed against cushion pads 4 by a metallic locking plate 6 which has bent tongues 8 and 9, respectively engaging the axial ends of base 3*a* and undercuts 10 in groove 2. Locking plate 6 thereby prevents axial movement of blade 3 with respect to metallic disk 1. Longitudinal recesses 7 are provided in the circular portion of groove 2 and engage the corners of locking plate 6. The circular cross-section of recesses 7 enables a small amount of bending movement of blade 3 which prevents excess stress on the base 3*a* when a bending moment arises, for example as the result of an offset center of gravity for the ceramic blade.

An important aspect of the invention is the nature and shape of the cushion pads 4. Cushion pads 4 have an elongated shape as is evident from FIG. 2 and an oval cross-section, as is seen in FIG. 1. The cushion pads are interposed between base 3*a* and the projecting section 5 of metallic disk 1. The engaging portion of base 3*a* is a concave first supporting surface which has a larger radius of curvature than the mating first cushion surface of cushion pad 4 in its relaxed state. Similarly, a second supporting surface, the curved supporting edge of projection 5 which engages the second cushion surface of cushion pads 4, has a larger radius of curvature than the second cushion surface. Cushion pad 4 is made from material having a selected yield pressure, which is less than the allowable surface pressure of the ceramic from which base portion 3*a* is made.

When the rotor is at rest, only a small amount of force, provided by locking plate 6, urges base portion 3*a* against cushion 4 and the supporting surface of projection 5. Because of the different radii of curvature, cushion pad 4 assumes its natural shape and the supporting surface of base portion 3*a* contacts the cushion pad only over a relatively small surface area, for example a line running the length of pad 4 in cross-section FIG. 2. When the rotor is operating, centrifugal forces push the base portion 3*a* against cushion pad 4, and pad 4 deforms against the first supporting surface as the force increases, so that a larger contact area exists. The supporting pressure is thereby maintained at less than the allowable surface pressure of the ceramic, because of the selected resilient characteristic of pad 4.

The differential curvature of the engaging surface on base 3*a* and pad 4 facilitates rotational movement of base 3*a* in the event bending moments ae exerted on blade 3, for example by a displaced center of gravity. If cushion pads 4 are provided with an antifriction coating, relative movement is facilitated and shearing stresses on the ceramic surfaces are substantially avoided.

The cross-sectional view of FIG. 2 illustrates a hollowed out portion 11 on projecting portion 5 of metallic rotor 1. This undercut portion reduces the rotor weight at the extreme edge of the metallic disk and consequently lowers the total centrifugal forces on the metallic disk 1.

While there has been described what is believed to be the preferred embodiment of the invention, those skilled in the art will recognize that other and further modifications may be made thereto without departing from the spirit of the invention, and it is intended to claim all such embodiments as fall within the true scope of the invention.

I claim:

1. A rotor for an axial flow turbine comprising a metallic disk having a plurality of spaced apart undercut grooves around its periphery, a plurality of ceramic rotor blades, one mounted in each of said grooves, said rotor blades having an enlarged base portion having first supporting surfaces, for engaging second supporting surfaces on said disk comprising the undercut portion of said grooves, and cushion pads interposed between said first and second supporting surfaces, each of said cushion pads being fabricated from resilient material having a selected yield pressure, less than the allowable surface pressure of said ceramic, and having a first cushion surface engaging one of said first supporting surfaces, said first cushion surface having a different radius of curvature in the relaxed state than said first supporting surface, said first cushion surface contacting said first supporting surface over a relatively small area when said rotor is at rest and said contact area increasing with rotation of said rotor as said surfaces are urged together by centrifugal force acting on each of said blades.

2. A rotor in accordance with claim 1 wherein said first supporting surface is concave and has a larger radius of curvature than said first cushion surface.

3. A rotor in accordance with claim 1 wherein said grooves extend axially in said disk and include a radially inner groove portion having a circular cross-section.

4. A rotor in accordance with claim 1 wherein said cushion pads have an oval cross-section and include said first cushion surface and a second cushion surface, and wherein the radius of curvature of said first cushion surface is less than the radius of curvature of said first supporting surface and the radius of curvature of said second cushion surface is less than the radius of curvature of said second supporting surface.

5. A rotor in accordance with claim 4 wherein said cushion pads are coated with antifriction material.

6. A rotor in accordance with claim 1 wherein there are provided locking plates acting on the radially inner end of said rotor blades and bearing on the radially inner end of said grooves.

7. A rotor in accordance with claim 6 wherein longitudinal recesses are provided in said grooves for supporting said locking plates.

8. A rotor in accordance with claim 6 wherein said locking plate is provided with tongues extending radially inward and outward for axially securing said rotor blade with respect to said disk.

* * * * *